US008528632B2

(12) United States Patent
Mack et al.

(10) Patent No.: US 8,528,632 B2
(45) Date of Patent: Sep. 10, 2013

(54) PACKER DEPLOYMENT WITH ELECTRIC SUBMERSIBLE PUMP WITH OPTIONAL RETENTION OF THE PACKER AFTER PUMP REMOVAL

(75) Inventors: John J. Mack, Catossa, OK (US); Brown L. Wilson, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 344 days.

(21) Appl. No.: 12/883,666

(22) Filed: Sep. 16, 2010

(65) Prior Publication Data

US 2012/0067564 A1 Mar. 22, 2012

(51) Int. Cl.
*E21B 43/00* (2006.01)
*E21B 33/12* (2006.01)

(52) U.S. Cl.
USPC ..... 166/106; 166/117; 166/372; 166/387

(58) Field of Classification Search
USPC ..... 166/106, 187, 387, 133, 188, 372, 166/377, 117
See application file for complete search history.

(56) References Cited

U.S. PATENT DOCUMENTS

| | | | | |
|---|---|---|---|---|
| 3,375,874 | A * | 4/1968 | Cherry et al. | 166/114 |
| 4,350,205 | A * | 9/1982 | Goldschild et al. | 166/375 |
| 4,589,632 | A | 5/1986 | Smith | |
| 5,320,182 | A | 6/1994 | Mendez | |
| 5,404,946 | A | 4/1995 | Hess | |
| 7,055,595 | B2 | 6/2006 | Mack et al. | |
| 7,971,649 | B2 * | 7/2011 | Zupanick | 166/370 |
| 2009/0032244 | A1 * | 2/2009 | Zupanick | 166/105.5 |
| 2009/0255691 | A1 | 10/2009 | Loughlin et al. | |

* cited by examiner

*Primary Examiner* — Jennifer H Gay
(74) *Attorney, Agent, or Firm* — Steve Rosenblatt

(57) ABSTRACT

An electric submersible pump ESP is run in to a desired subterranean location with a packer attached. Once at the desired location the packer is set either using the ESP or some other source of force or pressure. After the ESP has completed the task and needs to be removed, the packer stays set and the ESP releases from it. Removal of the ESP assembly allows a valve in the packer mandrel to close to isolate the zone from which the ESP had been pumping. The ESP can be run in on coiled tubing or rigid tubing or wireline.

20 Claims, 1 Drawing Sheet

PACKER DEPLOYMENT WITH ELECTRIC SUBMERSIBLE PUMP WITH OPTIONAL RETENTION OF THE PACKER AFTER PUMP REMOVAL

FIELD OF THE INVENTION

The field of the invention is placement and setting of a packer using an electric submersible pump (ESP) and more particularly the ability to remove the ESP while leaving the packer behind to secure the wellbore below.

BACKGROUND OF THE INVENTION

ESPs have previously required a separate run to locate and set the packer. After the packer was set the ESP assembly would be run in and stabbed into the packer so the ESP could then be operated. More recently in U.S. Pat. No. 7,055,595 the ESP was run in together with an inflatable with a line from the pump discharge going to the inflatable so that when the desired location was reached the pump was turned on and the inflatable was inflated. When the pump was shut off the inflatable deflated and was taken out with the ESP.

Other art that relates generally to the field of inflatables or packers or ESPs comprises U.S. Pat. Nos. 5,320,182; 4,589,632 and 5,404,946. Also of interest is US Publication 2009/0255691.

What is needed and not provided in the past is a way to run in an ESP with a packer and not only set the packer using the ESP or some other way but also a way to disconnect from the set packer when it is time to remove the ESP for repair or other reasons. The removal from the packer mandrel will allow a valve to close to secure the formerly produced zone. The ESP can be run in with coiled or rigid tubing or on wireline, for example. The packer type can be set mechanically or with pressure from the ESP or another pressure source from the surface. Removal of the ESP can allow a valve in the packer mandrel to close to block off the zone from which the ESP had been pumping before its removal. Those skilled in the art will more readily appreciate the details of the invention from the description of the preferred embodiment and the associated drawings while recognizing that the full scope of the invention is to be determined from the appended claims.

SUMMARY OF THE INVENTION

An ESP is run in to a desired subterranean location with a packer attached. Once at the desired location the packer is set either using the ESP or some other source of force or pressure. After the ESP has completed the task and needs to be removed, the packer stays set and the ESP releases from it. Removal of the ESP assembly allows a valve in the packer mandrel to close to isolate the zone from which the ESP had been pumping. The ESP can be run in on coiled tubing or rigid tubing or wireline.

DETAILED DESCRIPTION OF THE PREFERRED EMBODIMENT

Figure 1:
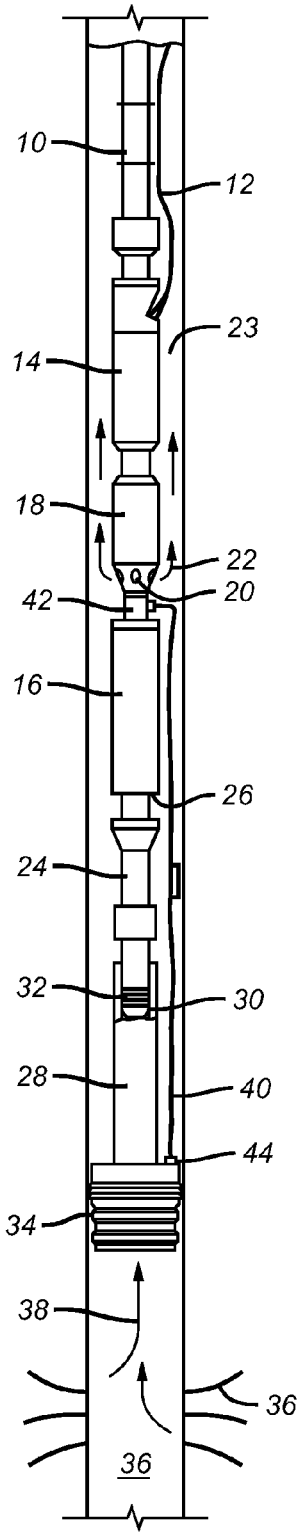
FIG. 1 shows the ESP assembly in position with the packer set.

Referring to FIG. 1 the assembly that is illustrated is placed in position at a subterranean location by rigid tubing or coiled tubing or wireline or an equivalent support 10 which also allows the motor leads 12 to be supported. The motor leads 12 terminate at a motor 14 that runs the ESP 16 through a seal section 18. The ESP has discharge ports 20 and arrows 22 represent the flow in the annulus 23 back to the surface that is pumped by the ESP 16. A stinger 24 is a tubular assembly connected to the suction end 26 of ESP 16 and that releasably extends into the reservoir control valve 28. There is a sealable bore receptacle 30 at the upper end of the reservoir control valve 28. The stinger 24 has seals 32 at its lower end that land in the sealable bore receptacle 30 and it releasably latched with a latch assembly that is of a design known in the art. The latch releases the stinger 24 on application of a predetermined pulling force. The reservoir control valve 28 supports a packer 34 that when set allows access to zone 36 so that the ESP 16 can pull fluid through the stinger 24 as illustrated by arrows 38. A jumper line 40 is connected from the discharge end 42 of the ESP 16 to the packer setting mechanism schematically illustrated on the top of the packer 34 as 44. Part of assembly 44 can be a breakaway coupling with a check valve or valves so that when the assembly illustrated down to the stinger 24 is to be removed from the reservoir control valve 28 so that valve 28 can close to isolate zone 36, the jumper line 40 will come apart from the packer 34 at assembly 44 and the line 40 will come out with the ESP 16.

Alternative setting arrangements for the packer 34 are contemplated where the jumper line 40 is not required. The packer 34 can be set with mechanical force, torque, hydrostatic pressure, applied pressure with an onboard pressure source or other equivalent ways. The packer design can be an inflatable or a compression set type that is powered by applied force or pressure to set the sealing element and slips in a known way.

Existing packers can be set with the illustrated system and a newly designed packer is not required. The primary advantage of the above described system is the ability to release from the packer 34 that had been run in with the ESP 16 and to do so in a manner that allows isolation of the zone 36 that had previously been produced.

Figure 2:
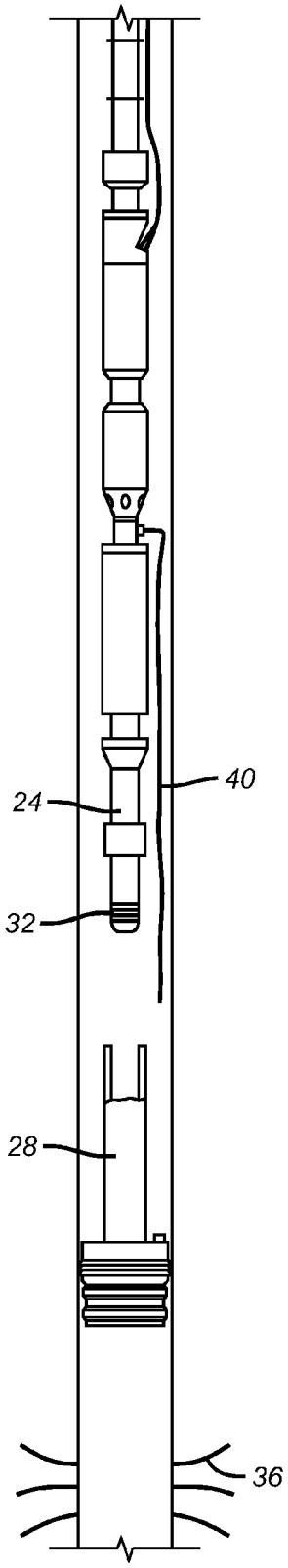
FIG. 2 shows the ESP assembly being removed leaving the packer and the reservoir control valve behind at the subterranean location.

FIG. 2 illustrates the seals 32 coming out of the sealable bore 30 of the reservoir control valve 28 and bringing out the jumper line 40 at the same time. Zone 36 is now isolated as the removal of the stinger 24 has allowed the reservoir control valve 28 to close.

As an option if the pressure from the ESP 16 is not sufficient a pressure intensifier 46 can be added to the jumper line 40 to raise the pressure level high enough to set the packer 34.

The above description is illustrative of the preferred embodiment and many modifications may be made by those skilled in the art without departing from the invention whose scope is to be determined from the literal and equivalent scope of the claims below.

We claim:

1. An assembly for subterranean use accessible from a surface location, comprising:

a motor driven pump;

a packer releasably supported by said pump to allow said packer to be delivered with said pump and to remain at the subterranean location when said pump is subsequently removed;

said packer further comprising a reservoir control check valve that closes to flow from the subterranean location through said packer and toward the surface location due to separation of said motor driven pump from said packer.

2. The assembly of claim 1, wherein:
said pump is connected to said packer for setting said packer when said pump is operating.
3. The assembly of claim 2, wherein:
said pump comprises an electric submersible pump (ESP).
4. The assembly of claim 3, further comprising:
a reservoir control valve mounted to said packer further comprising a receptacle;
a stinger connected to said pump having an end seal to seal in said receptacle.
5. The assembly of claim 1, wherein:
said packer is an inflatable packer.
6. The assembly of claim 1, wherein:
said packer comprises a seal set by mechanical compression.
7. The assembly of claim 1, further comprising:
said reservoir control valve mounted to said packer further comprising a receptacle;
a stinger connected to said pump having an end seal to seal in said receptacle.
8. The assembly of claim 7, wherein:
said receptacle comprises a sealable bore; and
said stinger is releasably secured to said sealable bore.
9. The assembly of claim 8, wherein:
said stinger releases from said sealable bore with a force applied to said stinger.
10. An assembly for subterranean use, comprising:
a motor driven pump;
a packer releasably supported by said pump to allow said packer to be delivered with said pump and to remain at the subterranean location when said pump is subsequently removed;
a reservoir control valve mounted to said packer further comprising a receptacle;
a stinger connected to said pump having an end seal to seal in said receptacle;
said receptacle comprises a sealable bore;
said stinger is releasably secured to said sealable bore;
said stinger releases from said sealable bore with a force applied to said stinger;
a jumper line from said pump to said packer for setting said packer, said jumper line releasing from said packer when said stinger releases for said sealable bore for removal of said jumper line with said stinger.
11. The assembly of claim 1, wherein:
said pump comprises an electric submersible pump (ESP).
12. The assembly of claim 11, wherein:
said ESP is supported for placement at the subterranean location by coiled tubing, or rigid tubing or wireline.
13. The assembly of claim 1, wherein:
said packer is set by moving said pump.
14. The assembly of claim 10, wherein:
said reservoir control valve closes when said stinger is removed from said reservoir control valve.
15. The assembly of claim 10, further comprising:
a pressure intensifier in said jumper line.
16. The assembly of claim 7, wherein:
said pump comprises an electric submersible pump (ESP) that is selectively released from said packer with a predetermined applied force to said stinger.
17. The assembly of claim 14, further comprising:
an opening into said packer for said jumper line closes when said jumper line is separated from said packer.
18. An assembly for subterranean use, comprising:
a motor driven pump;
a packer releasably supported by said pump to allow said packer to be delivered with said pump and to remain at the subterranean location when said pump is subsequently removed;
said pump is connected to said packer for setting said packer when said pump is operating;
said pump comprises an electric submersible pump (ESP);
a reservoir control valve mounted to said packer further comprising a receptacle;
a stinger connected to said pump having an end seal to seal in said receptacle;
a jumper line from said pump to said packer for setting said packer, said jumper line releasing from said packer when said stinger releases for said receptacle for removal of said jumper line with said stinger.
19. The assembly of claim 18, further comprising:
said reservoir control valve closes when said stinger is removed from said reservoir control valve.
20. The assembly of claim 19, further comprising:
an opening into said packer for said jumper line closes when said jumper line is separated from said packer.

* * * * *